US006935295B2

(12) United States Patent
Marriott

(10) Patent No.: US 6,935,295 B2
(45) Date of Patent: Aug. 30, 2005

(54) COMBUSTION-ASSISTED ENGINE START/STOP OPERATION WITH CYLINDER/VALVE DEACTIVATION

(75) Inventor: Craig D. Marriott, Clawson, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/669,480

(22) Filed: Sep. 24, 2003

(65) Prior Publication Data

US 2005/0061283 A1 Mar. 24, 2005

(51) Int. Cl.[7] ..... F02D 17/02; F02N 17/00
(52) U.S. Cl. ..... 123/179.5; 123/198 F
(58) Field of Search ..... 123/179.5, 179.18, 123/198 DB, 481, 198 F

(56) References Cited

U.S. PATENT DOCUMENTS 4,009,695 A * 3/1977 Ule ..... 123/90.13
5,623,897 A 4/1997 Hampton et al.
6,039,026 A * 3/2000 Shiraishi et al. ..... 123/399
6,092,497 A 7/2000 Preston et al.
6,196,175 B1 3/2001 Church
6,321,704 B1 11/2001 Church et al.
6,467,445 B1 10/2002 Harris
6,497,207 B2 12/2002 Spath et al.
6,513,470 B1 2/2003 Hendriksma et al.
6,546,910 B2 * 4/2003 Tanaka et al. ..... 123/198 F

* cited by examiner

*Primary Examiner*—Andrew M. Dolinar
(74) *Attorney, Agent, or Firm*—Christopher DeVries

(57) ABSTRACT

A method for enabling combustion-assisted engine starting includes adjusting a throttle valve to provide an air flow rate to an engine of a vehicle that is sufficient to create starting torque. Fuel that is sufficient to create starting torque is injected into a cylinder of the engine during an intake stroke of the cylinder. A spark plug of the cylinder is disabled. An intake and exhaust valve of the cylinder are disabled. The engine is deactivated. A method for activating the engine includes enabling the spark plug. A piston of the cylinder is positioned between a TDC position of a compression stroke and a BDC position of an expansion stroke or between a TDC position of an exhaust stroke and a BDC position of an intake stroke. A fuel/air charge that is sufficient to create starting torque is ignited in the cylinder. The intake and exhaust valve are activated.

17 Claims, 6 Drawing Sheets

COMBUSTION-ASSISTED ENGINE START/STOP OPERATION WITH CYLINDER/VALVE DEACTIVATION

FIELD OF THE INVENTION

The present invention relates to combustion engines, and more particularly to combustion-assisted engine start/stop operation.

BACKGROUND OF THE INVENTION

Spark-Ignition (SI) combustion engines typically consume a significant amount of fuel during activation and idle operation. Various methods including Belt Alternator/Starter (BAS) systems and hybrid electric drivetrain systems have been proposed to reduce fuel consumption. Combustion-assisted start/stop operation involves trapping a fuel/air charge that is sufficient to produce starting torque in at least one cylinder during engine deactivation.

During activation, cylinders containing the trapped fuel/air charge in the proper position are ignited to rotate a crankshaft of the engine. The resulting motion positions subsequent cylinders of the engine for combustion. In order to accomplish combustion-assisted starting, the fuel/air charge must be sufficient to produce starting torque in at least one cylinder having a piston positioned after a Top Dead-Center (TDC) position of a compression stroke and before a Bottom Dead-Center (BDC) position of an expansion stroke.

In one approach, combustion-assisted starting is implemented in a direct-injection gasoline SI engine with a conventional valvetrain system. To enable combustion-assisted starting, the following shutdown sequence is performed in chronological order. First, an Electronic Throttle Control (ETC) adjusts a Manifold Absolute Pressure (MAP) of the vehicle to provide an air flow rate that is required to produce starting torque of the engine. Second, a sufficient amount of fuel to produce the starting torque is injected into some of the cylinders. Third, the ignition systems of the cylinders containing a trapped fuel/air charge are deactivated. Fourth, the engine is deactivated so that the crankshaft comes to rest between one-half and one revolution after BDC of an intake stroke of the first cylinder in sequence with a trapped air/fuel charge.

However, if the crankshaft comes to rest during a compression stroke of the first cylinder in sequence, the opportunity to start the engine with the crankshaft rotating in the proper direction is lost. Additionally, if the crankshaft comes to rest during the exhaust stroke of the first cylinder in sequence, the unburned fuel/air charge is discharged to the exhaust system. This eliminates the possibility for combustion-assisted starting and compromises vehicle emissions.

SUMMARY OF THE INVENTION

A method for enabling combustion-assisted engine starting according to the present invention includes adjusting a throttle valve to provide an air flow rate to an engine of a vehicle that is sufficient to create starting torque. Fuel that is sufficient to create the starting torque is injected into a cylinder of the engine during an intake stroke of the cylinder. A spark plug of the cylinder is disabled. An intake and exhaust valve of the cylinder are disabled. The engine is deactivated.

In other features, at least one additional cylinder of the engine is enabled for combustion-assisted starting before the deactivating step. The throttle valve adjusts a Manifold Absolute Pressure (MAP) of an intake manifold in the engine. An Electronic Throttle Control (ETC) adjusts the throttle valve. The engine is one of a multi-port fuel injected spark-ignition engine and a direct-injection spark-ignition engine.

A method for activating an engine enabled for combustion-assisted starting according to the present invention, wherein intake and exhaust valves of one or more cylinders in the engine are deactivated and spark plugs of the one or more cylinders are disabled, includes enabling the spark plugs. A fuel/air charge that is sufficient to create starting torque is ignited in at least one of the one or more cylinders.

In other features, a piston of the at least one of the one or more cylinders is positioned between a Top Dead Center (TDC) position of a compression stroke and a Bottom Dead Center (BDC) position of an expansion stroke before the igniting step. A piston of the at least one of the one or more cylinders is positioned between a TDC position of an exhaust stroke and a BDC position of an intake stroke before the igniting step. An intake and exhaust valve of the at least one of the one or more cylinders are activated after the igniting step.

In still other features of the invention, the engine is one of a multi-port fuel injected spark-ignition engine and a direct-injection spark-ignition engine. Fuel/air charges in two of four cylinders in a four cylinder engine, four of six cylinders in a six cylinder engine, four of eight cylinders in an eight cylinder engine, six of ten cylinders in a ten cylinder engine, six of twelve cylinders in a twelve cylinder engine, and ten of sixteen cylinders in a sixteen cylinder engine are ignited in the igniting step.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
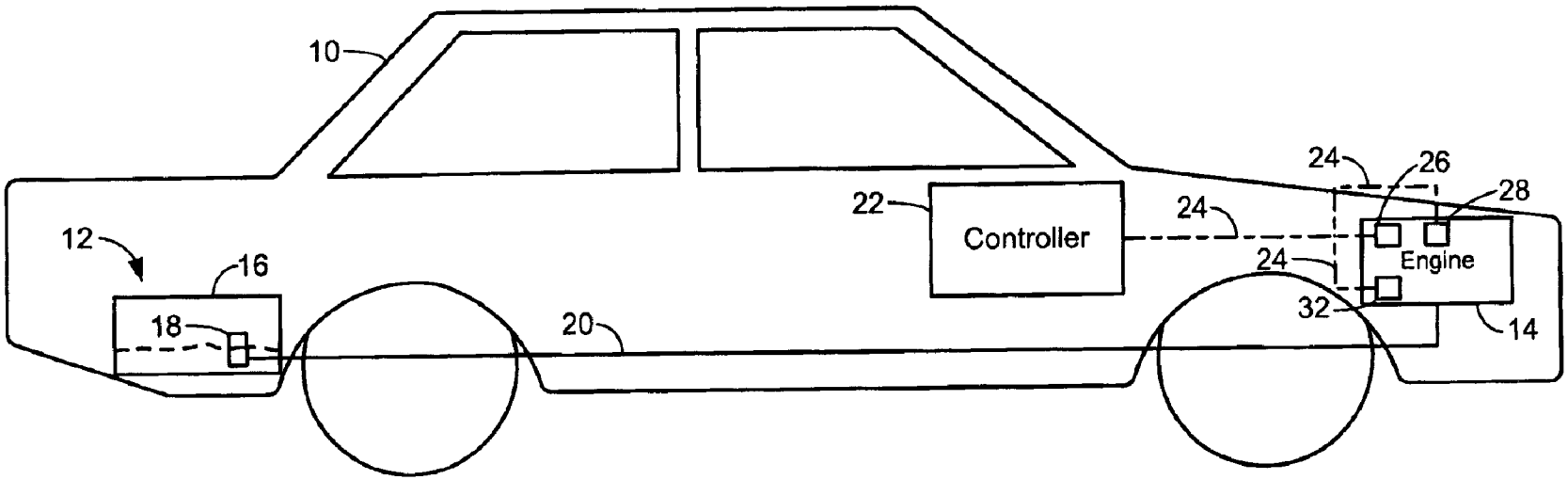
FIG. 1 Prior Art
FIG. 1 illustrates a vehicle including a controller that communicates with vehicle systems.

The following description of the preferred embodiment(s) is merely exemplary in nature and is in no way intended to limit the invention, its application, or uses. For purposes of clarity, the same reference numbers will be used in the drawings to identify similar elements.

Referring to FIG. 1, a vehicle 10 includes a fuel system 12 that provides fuel to an engine 14 for combustion. The fuel system 12 includes a fuel tank 16 that stores the fuel. A fuel pump 18 pumps the fuel through a fuel line 20 to the engine 14. A controller 22 receives signals 24 from sensors in the vehicle 10 to monitor conditions of the vehicle 10 and/or vehicle systems. The sensors include a Throttle Position Sensor (TPS) 26 and a Manifold Absolute Pressure (MAP) sensor 28. Still other sensors may be employed. Additionally, the controller 22 communicates with an Electronic Throttle Control (ETC) 32. While one controller is shown in FIG. 1, multiple controllers can be used. Additionally, the controller 22 may be part of an Engine Control Unit (ECU).

Figure 2B:
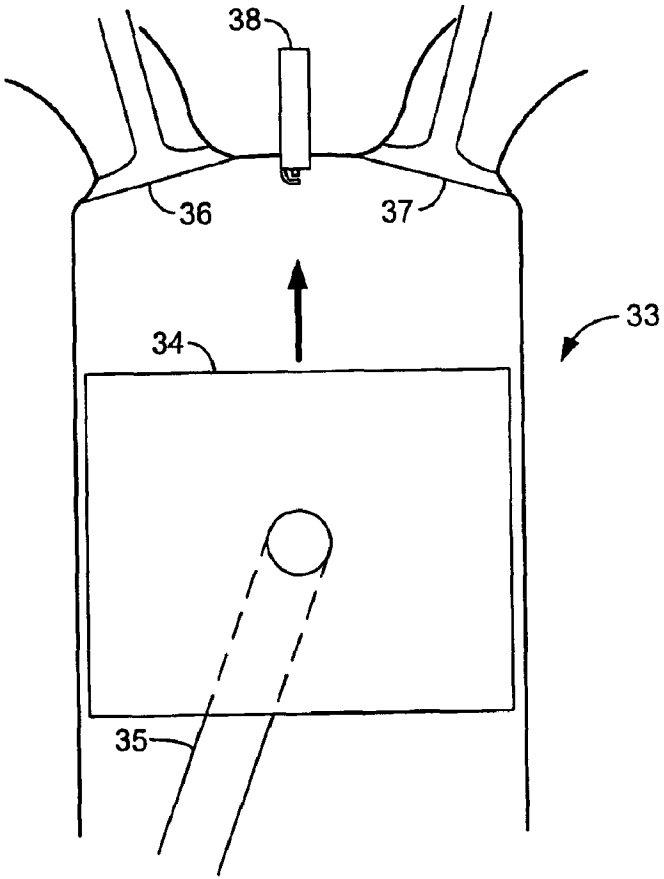
FIG. 2B Prior Art
FIG. 2B illustrates the exemplary cylinder during a compression stroke.
Figure 2A:
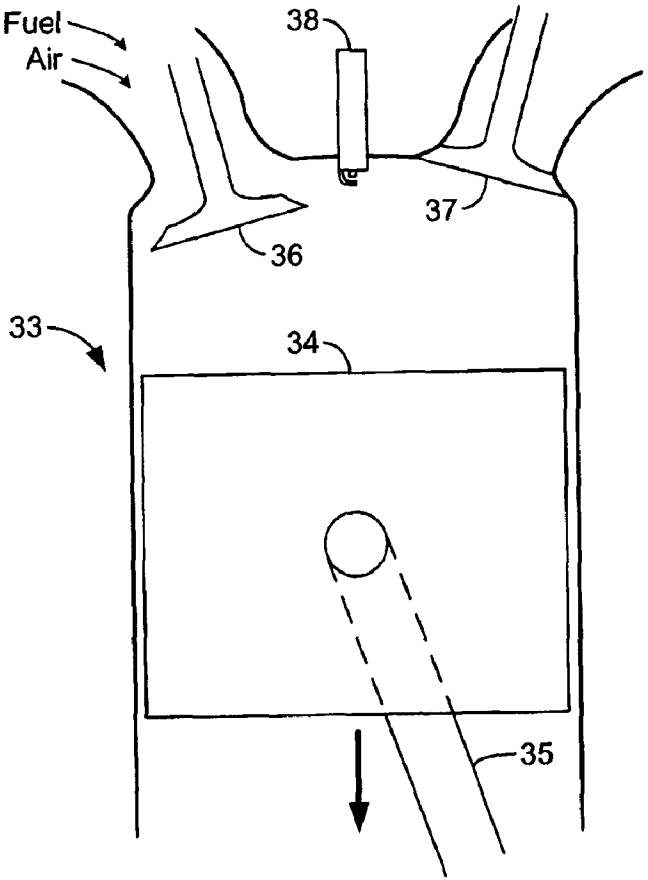
FIG. 2A Prior Art
FIG. 2A illustrates an exemplary cylinder in an engine during an intake stroke.

Referring now to FIG. 2A, an exemplary cylinder 33 in the engine 14 includes a piston 34 that is connected to a connecting rod 35. An intake valve 36 allows air and/or fuel to enter the exemplary cylinder 33. An exhaust valve 37 allows exhaust to escape the exemplary cylinder 33. While one intake and exhaust valve 36 and 37, respectively, are shown in FIG. 2A, the exemplary cylinder 33 may include two or more intake and exhaust valves 36 and 37, respectively. A spark plug 38 is capable of igniting an air/fuel mixture in the exemplary cylinder 33. FIG. 2A illustrates the exemplary cylinder 33 during an intake stroke. During the intake stroke, the piston 34 moves downward while the intake valve 36 opens to allow an air/fuel mixture to enter the exemplary cylinder 33.

Referring now to FIG. 2B, the piston 34 moves upward during a compression stroke. The intake and exhaust valves 36 and 37, respectively, are closed so that the air/fuel mixture is compressed due to the upward motion of the piston 34. At the end of the compression stroke, the spark plug 38 ignites the fuel/air mixture to drive the piston 34 downward.

Figure 2D:
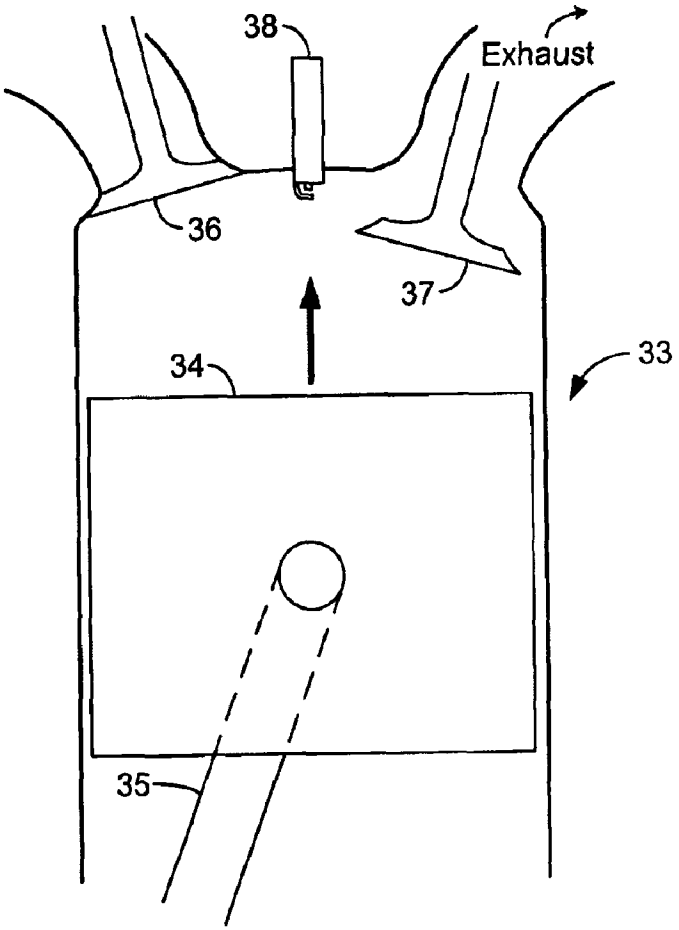
FIG. 2D Prior Art
FIG. 2D illustrates the exemplary cylinder during an exhaust stroke.
Figure 2C:
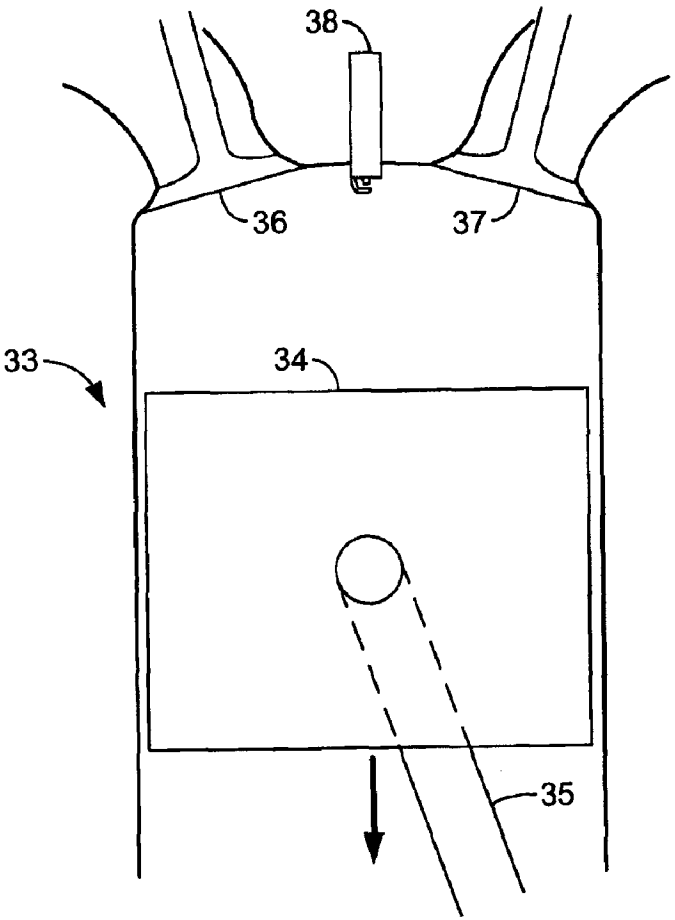
FIG. 2C Prior Art
FIG. 2C illustrates the exemplary cylinder during an expansion stroke.

Referring now to FIG. 2C, the piston 34 moves downward during an expansion stroke. The piston 34 is driven downward when the spark plug 38 ignites the fuel/air mixture. This allows the connecting rod 35 and an associated crankshaft to produce rotational motion that drives the vehicle 10.

Referring now to FIG. 2D, the piston 34 moves upward during an exhaust stroke. The exhaust valve 37 opens to allow exhaust from the combusted fuel/air mixture to escape the exemplary cylinder 33, and the cycle repeats with another intake stroke as illustrated in FIG. 2A.

Figure 3:
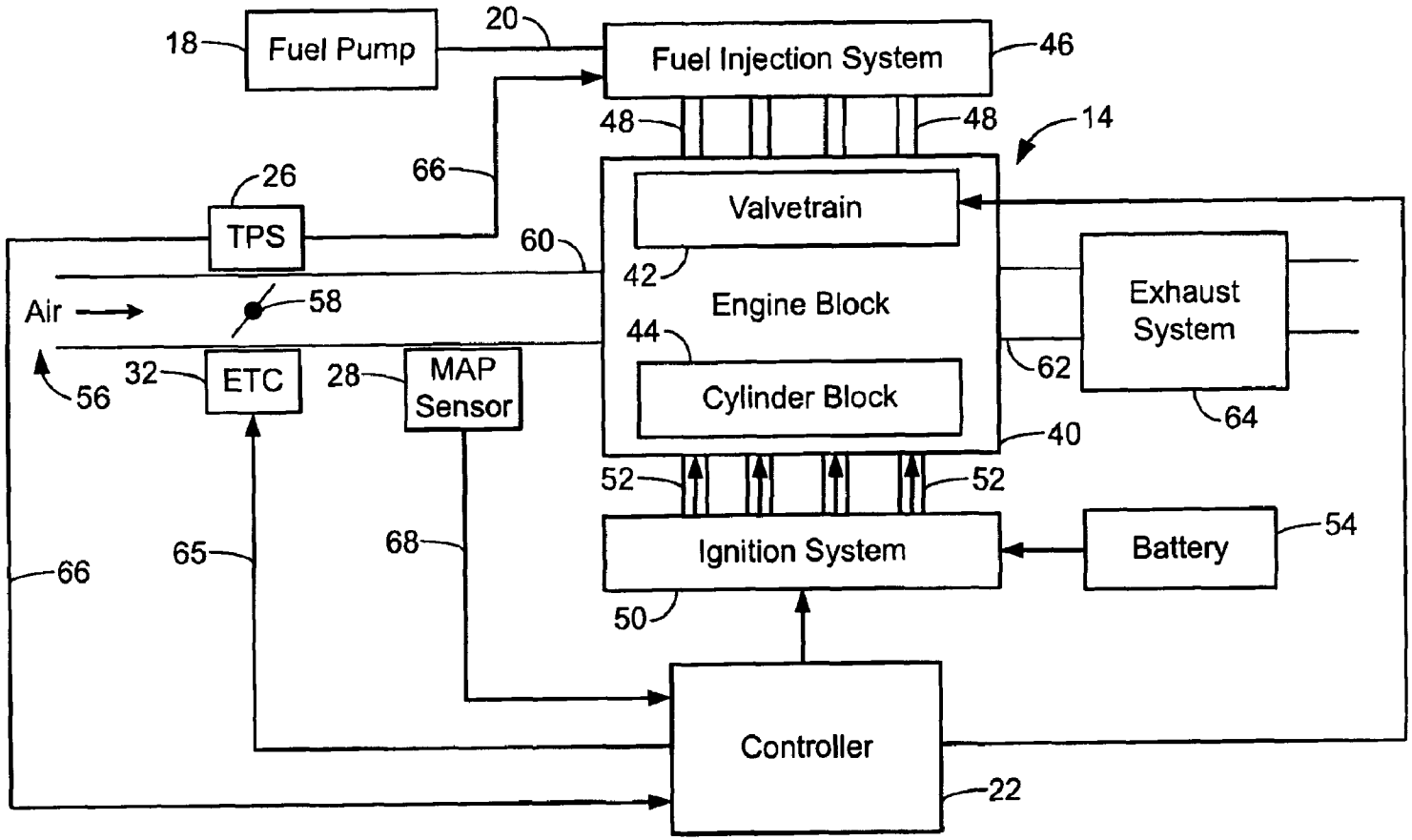
FIG. 3 is a functional block diagram of a combustion-assisted engine start/stop system according to the present invention.

Referring now to FIG. 3, the engine 14 is illustrated in further detail. An engine block 40 houses components of the engine 14 including a valvetrain 42 and a cylinder block 44. The cylinder block 44 may include any number or arrangement of cylinders including 4, 5, 6, 8, 10, 12, 16, etc. cylinders. The valvetrain 42 includes intake valves 36 that allow fuel and/or air to enter the cylinders for combustion and exhaust valves 37 that allow exhaust to escape the cylinders. The valvetrain 42 implements valve deactivation hardware capable of disabling the intake valves 36 and/or exhaust valves 37 of one of more of the cylinders. The valve deactivation hardware may use any method of valvetrain deactivation. For example, the valve deactivation hardware may include a push rod set telescoping lifter arrangement as described in U.S. Pat. No. 6,513,470 to Hendriksma et al., a roller follower with an end pivot latching rocker arm as described in U.S. Pat. No. 6,321,704 to Church et al., a roller follower with a central pivot latching rocker arm as describes in U.S. Pat. No. 6,467,445 to Harris, which are all hereby incorporated by reference, or any other suitable system.

The fuel pump 18 supplies liquid fuel such as gasoline to a fuel injection system 46 through the fuel line 20. The fuel injection system 46 includes fuel injectors 48 that supply the liquid fuel to the cylinders in the cylinder block 44. The liquid fuel is mixed with air in the cylinders and combusted to power the engine 14. The fuel injection system 46 is preferably a multi-port fuel injection system. However, the present invention is applicable to other fuel injection systems including direct injection and single-point fuel injection systems. An ignition system 50 includes spark plugs 38 that ignite the fuel/air charges in the cylinders. The combustion displaces the cylinders to drive the vehicle 10. A battery 54 provides electric power for the spark plugs 38 to combust the fuel/air charges.

Air enters the vehicle 10 through an air intake 56. The air passes by a throttle valve 58 and enters an intake manifold 60. The throttle valve 58 controls an air flow rate to the engine 14 and the Manifold Absolute Pressure (MAP) of the intake manifold 60. For example, the throttle valve 58 increases the air flow rate when the vehicle 10 accelerates. The intake valves 36 of a cylinder allow air to enter the cylinder from the intake manifold 60. Combustion exhaust from the cylinders exits the engine 14 through an exhaust manifold 62 and enters an exhaust system 64. The exhaust system 64 may include a catalytic converter that treats the exhaust before it is emitted to the atmosphere from the vehicle 10.

The controller 22 transmits a throttle signal 65 to the ETC 32 to adjust the position of the throttle valve 58. The TPS 26 monitors the position of the throttle valve 58 and transmits a throttle position signal 66 to the controller 22 and the fuel injection system 46. The fuel injection system 46 adjusts the rate that the fuel injectors 48 supply fuel to the cylinders based on the position of the throttle valve 58. The MAP sensor 28 monitors the MAP of the intake manifold 60 and transmits a MAP signal 68 to the controller 22.

The controller 22 communicates with the ignition system 50 and is capable of disabling one or more spark plugs 38. The controller 22 also communicates with the valvetrain 42 and is capable of disabling the intake valves 36 and/or exhaust valves 37 of one or more cylinders.

To accomplish combustion-assisted starting, the pistons 34 of one or more cylinders containing a trapped fuel/air charge must come to rest between Top Dead-Center (TDC) of a compression stroke and Bottom Dead-Center (BDC) of an expansion stroke or between TDC of an exhaust stroke and BDC of an intake stroke. On an even-firing cylinder engine, the maximum number of cylinders that may be fired upon a commanded start is two of four cylinders, four of six cylinders, four of eight cylinders, six of ten cylinders, six of twelve cylinders, and ten of sixteen cylinders.

To enable combustion-assisted starting, a specific engine shutdown sequence is followed. The controller 22 initiates the engine shutdown sequence due to the vehicle 10 being in a low-power condition or for other reasons. For example, a low-power condition may include a situation where a brake of the vehicle 10 is applied and no vehicle systems require a significant amount of power. First, the ETC 32 adjusts the throttle valve 58 to produce a desired MAP. The desired MAP produces an air flow rate to the cylinder block 44 that is sufficient to create a starting torque of the engine 14. As each cylinder desired for combustion-assisted starting enters the intake stroke, the fuel injectors 48 inject an amount of fuel sufficient to create the starting torque into the cylinder. The controller 22 disables the spark plugs 38 of the cylinders containing a trapped fuel/air charge prior to the respective expansion strokes. Therefore, trapped fuel/air charges remain in the cylinders with disabled spark plugs 38 during respective expansion strokes. Finally, the controller 22 deactivates the intake and exhaust valves 36 and 37, respectively, of the cylinders containing a trapped fuel/air charge before the respective exhaust strokes. The cylinders that are not enabled for combustion-assisted starting are deactivated by normal methods. For example, the fuel injection system may be deactivated to stop the engine 14.

The process is performed on one or more cylinders. When the process is performed on one-half or more of the cylinders for engines with four or more cylinders, it is likely that at least one cylinder will be available for combustion-assisted starting. The cylinders with a disabled spark plug 38 and deactivated intake and exhaust valves 36 and 37, respectively, maintain a trapped fuel/air charge regardless of continuing revolutions by the crankshaft. Therefore, continuing revolutions by the crankshaft do not inhibit the ability to perform combustion-assisted starting or compromise vehicle emissions.

The prior art method of combustion-assisted starting that implements ignition deactivation limits the possible number of cylinders that are available for engine starting. For example, implementing only ignition deactivation provides the opportunity to ignite a maximum of one of four cylinders, two of six cylinders, and three of eight cylinders upon an engine start command. The method of the present invention implements intake and exhaust valve 36 and 37, respectively, deactivation and provides the opportunity to trap a fuel/air charge in all cylinders during shutdown. Additionally, the intake and exhaust valve 36 and 37, respectively, deactivation provides the opportunity to ignite more cylinders during engine activation.

It is advantageous to allow the crankshaft to complete two full revolutions after a first cylinder contains a trapped fuel/air charge. This provides the opportunity to trap fuel/air charges in all of the cylinders. If the combustion-assisted start/stop method of the present invention is not implemented in all of the cylinders of an engine, the prior art method of trapping a fuel/air charge with a conventional valvetrain may still be implemented in one or more cylinders. This provides the opportunity to trap additional fuel/air charges in the cylinders of an engine during shutdown while avoiding the cost of implementing valve deactivation hardware in all of the cylinders.

Upon an activation command, the spark plugs 38 of all of the cylinders containing a trapped fuel/air charge are enabled. For example, the activation command may be initiated by the vehicle 10 returning from the low-power condition. The cylinders containing trapped fuel/air charges with pistons 34 between TDC of respective compression strokes and BDC of respective expansion strokes and/or between TDC of respective exhaust strokes and BDC of respective intake strokes are then ignited. The resulting crankshaft motion positions the remaining cylinders containing trapped fuel/air charges for a properly timed ignition to provide additional crankshaft torque and acceleration. After the remaining cylinders containing a trapped fuel/air charge during shutdown are ignited, the respective intake and exhaust valves 36 and 37, respectively, are enabled prior to the respective exhaust strokes. However, it may be desirable to have the intake and exhaust valves 36 and 37, respectively, of one or more cylinders remain deactivated after engine activation. This would allow the engine 14 to conserve fuel by operating without being powered by all cylinders. Cylinders not containing a trapped fuel/air charge during shutdown operate normally during engine activation and are initially set in motion by the cylinders used for combustion-assisted starting.

Figure 4:
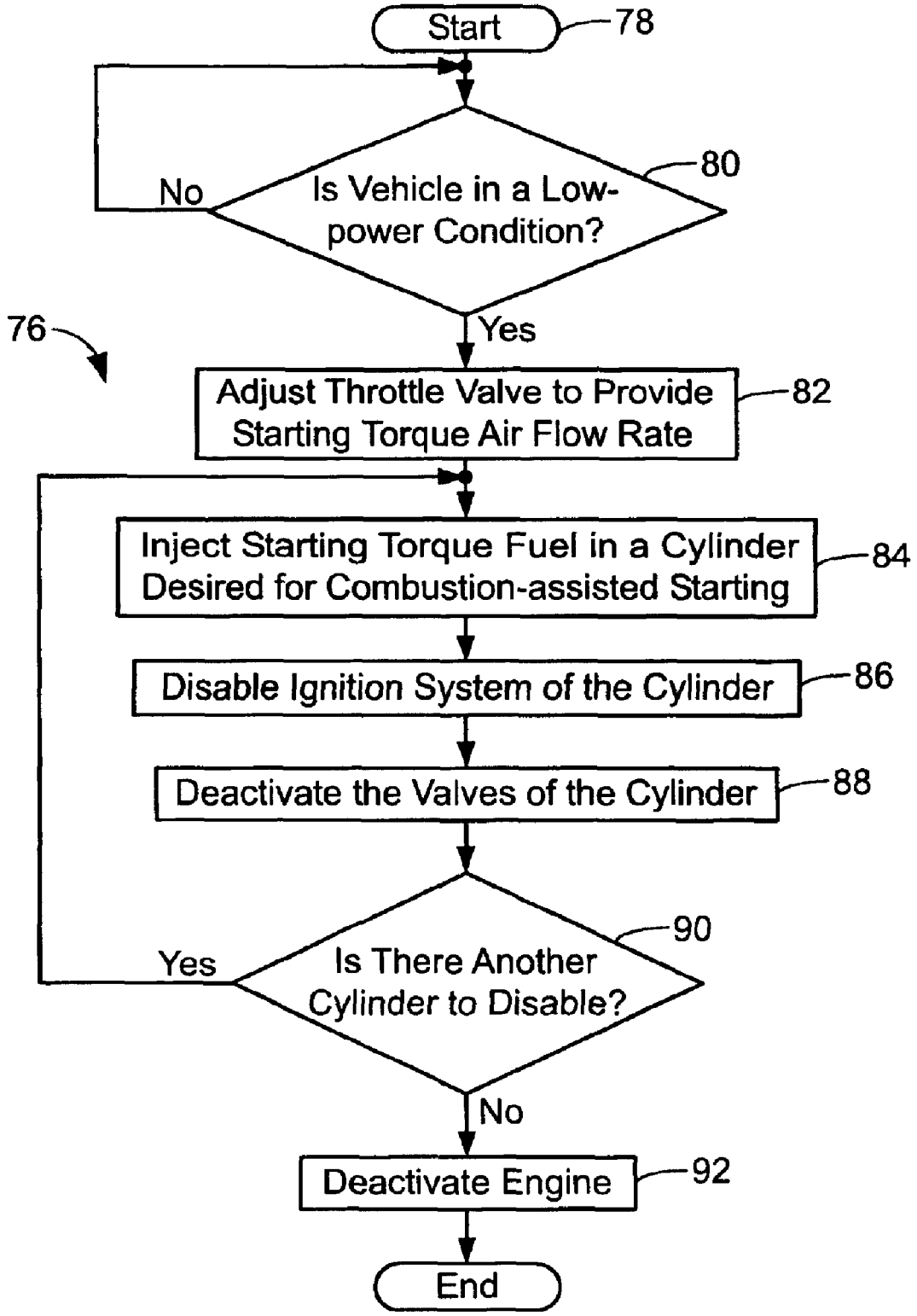
FIG. 4 is a flowchart illustrating steps of an engine shutdown method according to the present invention, which enables combustion-assisted starting.

Referring now to FIG. 4, an engine shutdown method 76 begins in step 78. In step 80, control determines whether the engine 14 is in a low-power condition. If false, control returns to step 80. If true, control proceeds to step 82. In step 82, the ETC 32 adjusts the throttle valve 58 to provide an air flow rate to the cylinder block 44 sufficient for a starting torque of the engine 14.

In step 84, the fuel injection system 46 injects an amount of fuel required for the starting torque in a cylinder desired for combustion-assisted starting. The amount of fuel is injected into the cylinder during the intake stroke of the cylinder. In step 86, the spark plug 38 of the cylinder is disabled prior to the end of the compression stroke. In step 88, the intake and exhaust valves 36 and 37, respectively, of the cylinder are deactivated prior to the exhaust stroke. In step 90, control determines whether there is another cylinder desired for combustion-assisted starting. If true, control returns to step 84. If false, control proceeds to step 92. In step 92, the engine is deactivated and control ends.

Figure 5:
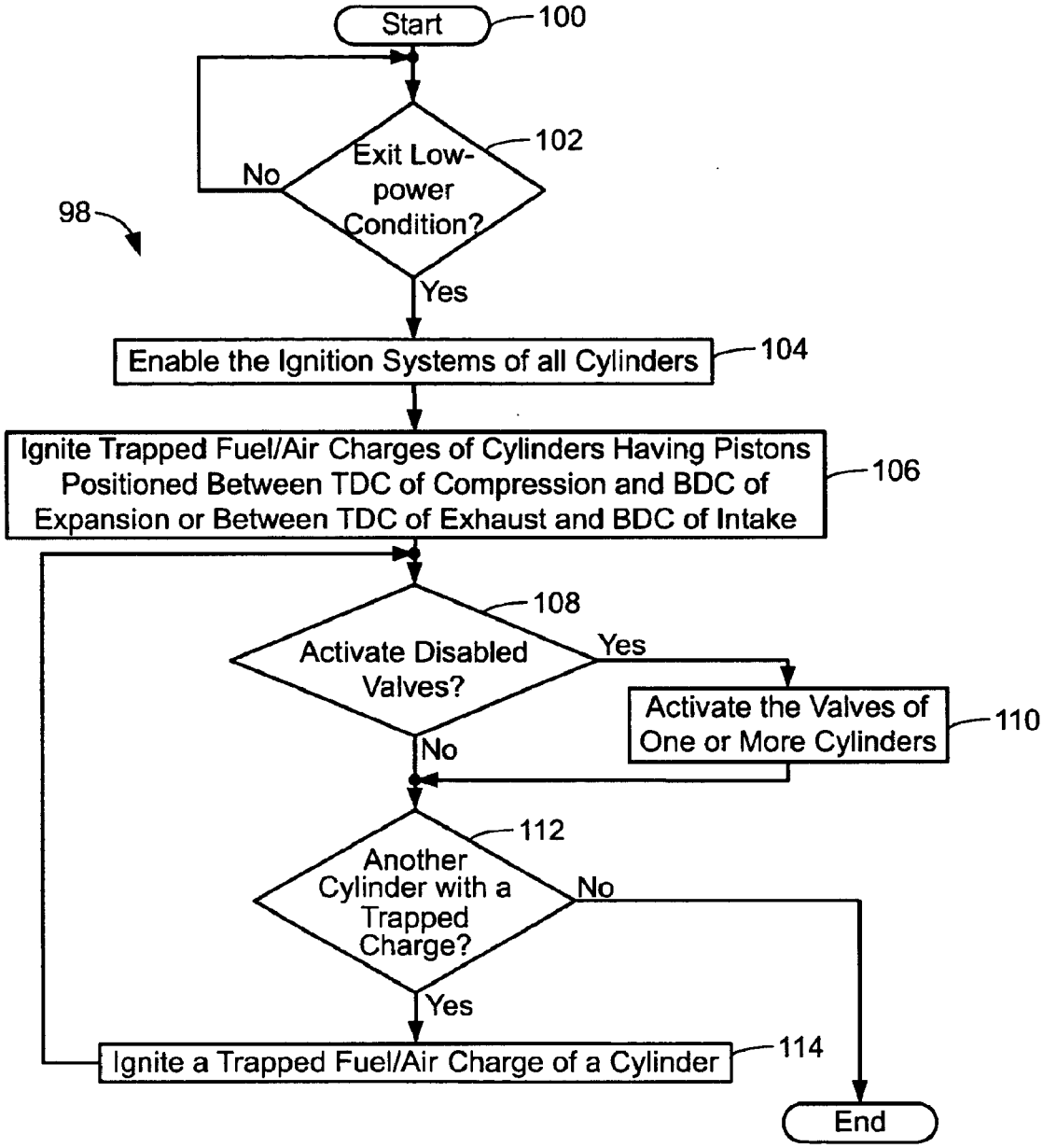
FIG. 5 is a flowchart illustrating steps of an engine activation method for an engine implementing combustion-assisted start/stop operation.

Referring now to FIG. 5, an engine activation algorithm 98 begins in step 100. In step 102, control determines whether the engine 14 is exiting the low-power condition. If false, control returns to step 102. If true, control proceeds to step 104. In step 104, the ignition system 50 enables the spark plugs 38 of all of the cylinders containing a trapped fuel/air charge. In step 106, the ignition system 50 ignites the cylinders containing a trapped fuel/air charge and having pistons 34 positioned between TDC of the compression stroke and BDC of the expansion stroke or between TDC of the exhaust stroke and BDC of the intake stroke.

In step 108, control determines whether any intake and exhaust valves 36 and 37, respectively, require activation. If false, control proceeds to step 112. If true, control proceeds to step 110. In step 110, intake and exhaust valves 36 and 37, respectively, that require activation are activated prior to the exhaust stroke. In step 112, control determines whether another cylinder contains a trapped fuel/air charge. If false, control ends. If true, control proceeds to step 114. In step 114, the ignition system 50 ignites a remaining cylinder containing a trapped fuel/air charge and control returns to step 108.

The method of the present invention enables fuel economy improvements and significantly reduces inefficient fuel consumption during idle operation or when the vehicle 10 is in a low-power condition. While the prior art method of combustion-assisted starting is limited in application to direct-injection SI engines, the method of the present invention may also be implemented in less-expensive port fuel-injection SI engines.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A method for enabling combustion-assisted engine starting in a variable displacement engine, comprising:

adjusting a throttle valve to provide an air flow rate to an engine of a vehicle that is sufficient to create starting torque;

injecting fuel that is sufficient to create said starting torque into a selected cylinder of said engine during an intake stroke of said cylinder;

disabling a spark plug of said selected cylinder;

disabling an intake and exhaust valve to trap said fuel in said selected cylinder while said variable displacement engine continues to run; and deactivating said variable displacement engine after disabling the spark plug and the intake and exhaust valves of said selected cylinder.

2. The method of claim 1 further comprising:

enabling at least one additional cylinder of said variable displacement engine for combustion-assisted starting before said deactivating step.

3. The method of claim 1 wherein said throttle valve adjusts a Manifold Absolute Pressure (MAP) of an intake manifold in said variable displacement engine.

4. The method of claim 1 wherein an Electronic Throttle Control (ETC) adjusts said throttle valve.

5. The method of claim 1 wherein said variable displacement engine is one of a multi-port fuel injected spark-ignition engine and a direct-injection spark-ignition engine.

6. A method for activating a variable displacement engine enabled for combustion-assisted starting, wherein intake and exhaust valves of one or more selected cylinders in said engine are deactivated at low load operating conditions to increase fuel economy and spark plugs of said one or more selected cylinders are disabled to trap a fuel/air charge in said selected cylinders while said engine continues to run, comprising:

enabling said spark plugs;

igniting said fuel/air charge, wherein said fuel/air charge is sufficient to create starting torque in at least one of said one or more selected cylinders.

7. The method of claim 6 wherein a piston of said at least one of said one or more selected cylinders is positioned between a Top Dead Center (TDC) position of a compression stroke and a Bottom Dead Center (BDC) position of an expansion stroke before said igniting step.

8. The method of claim 6 wherein a piston of said at least one of said one or more selected cylinders is positioned between a TDC position of an exhaust stroke and a BDC position of an intake stroke before said igniting step.

9. The method of claim 6 further comprising:

activating an intake and exhaust valve of said at least one of said one or more selected cylinders after said igniting step.

10. The method of claim 6 wherein said engine is one of a multi-port fuel injected spark-ignition engine and a direct-injection spark-ignition engine.

11. The method of claim 6 wherein fuel/air charges in a plurality of cylinders in said variable displacement engine are ignited in said igniting step.

12. A combustion-assisted engine start/stop system for a variable displacement engine, comprising:

an Electronic Throttle Control (ETC) that adjusts a position of a throttle valve in a vehicle;

a fuel injection system that injects fuel into a plurality of cylinders of said variable displacement engine based on said position;

an ignition system that is capable of disabling a spark plug in a selected one of said plurality of cylinders;

a valvetrain system that is capable of disabling an intake and exhaust valve in said selected one of said plurality of cylinders and to substantially prevent air flow in said selected one of said plurality of cylinders; and a controller that communicates with said ETC, said ignition system, and said valvetrain system, wherein combustion-assisted engine starting is enabled by containing a fuel/air charge sufficient for starting torque in said selected one of said plurality of cylinders when said spark plug and said intake and exhaust valve are disabled while said variable displacement engine continues to run.

13. The combustion-assisted engine start/stop system of claim 12 wherein all of said plurality of cylinders contain fuel/air charges sufficient for starting torque after a shutdown process of said variable displacement engine.

14. The combustion-assisted engine start/stop system of claim 12 wherein an activation process of said variable displacement engine ignites a plurality of cylinders in said variable displacement engine.

15. The combustion-assisted engine start/stop system of claim 12 wherein said position adjusts a Manifold Absolute Pressure (MAP) of said engine.

16. The combustion-assisted engine start/stop system of claim 12 wherein said variable displacement engine is one of a multi-port fuel injected spark-ignition engine and a direct-injection spark-ignition engine.

17. A method of operating a variable displacement engine comprising:

sensing a low load condition on said variable displacement engine;

deactivating at least one selected cylinder of said variable displacement engine to substantially prevent air flow through said at least one selected cylinder in response to said low load condition;

injecting fuel into said at least one selected cylinder while said at least one selected cylinder is deactivated;

operating said variable displacement engine in a partially displaced operating mode with said fuel in said at least one selected cylinder while air is substantially prevented from flowing through the at least one selected cylinder; and igniting the fuel in said at least one selected cylinder to operate said variable displacement engine in a fully displaced mode.

* * * * *